United States Patent [19]

Pedersen et al.

[11] 4,419,040

[45] * Dec. 6, 1983

[54] BACKHOE SWING MECHANISM

[75] Inventors: Carl O. Pedersen; Herman J. Maurer, both of Burlington, Iowa

[73] Assignee: J. I. Case Company, Racine, Wis.

[ * ] Notice: The portion of the term of this patent subsequent to Jun. 21, 2000 has been disclaimed.

[21] Appl. No.: 329,349

[22] Filed: Dec. 10, 1981

[51] Int. Cl.[3] ..... E02F 3/72

[52] U.S. Cl. ..... 414/687; 414/695.5; 414/694

[58] Field of Search ..... 414/687, 694, 744 R, 414/695.5; 91/176, 188, 210, 412 R

[56] References Cited

U.S. PATENT DOCUMENTS

| | | | |
|---|---|---|---|
| 3,047,171 | 7/1962 | Long | 414/744 R X |
| 3,407,946 | 10/1968 | Pilch | 414/695.5 |
| 3,530,766 | 9/1970 | Pilch | 414/695.5 |
| 3,630,120 | 12/1971 | Carlson et al. | 414/694 X |
| 3,757,642 | 9/1973 | Schuermann | 91/176 |
| 3,872,985 | 3/1975 | Short | 414/694 |
| 4,085,855 | 4/1978 | Worback | 414/694 |
| 4,138,928 | 2/1979 | Pilch | 414/694 X |
| 4,341,501 | 7/1982 | Maurer et al. | 414/694 |

*Primary Examiner*—Leslie J. Paperner
*Assistant Examiner*—Terrance L. Siemens
*Attorney, Agent, or Firm*—Dressler, Goldsmith, Shore, Sutker & Milnamow, Ltd.

[57] ABSTRACT

An improved hydraulic control system is disclosed for operating the swing tower and boom of a backhoe. The system includes a pair of hydraulic motors interconnected between the backhoe frame and swing tower. A sequencing valve is hydraulically associated with respective ends of the hydraulic motors and operates to direct the flow of pressurized hydraulic fluid to the motors for improved performance as they rotate the swing tower and boom. A hydraulic cushioning circuit associated with the sequencing valve provides an improved arrangement for cushioning of the swing mechanism as the swing tower and boom are moved toward either of their travel stops without the use of conventional cushioning devices.

19 Claims, 12 Drawing Figures

BACKHOE SWING MECHANISM

CROSS-REFERENCE TO RELATED APPLICATIONS

The present invention is related to U.S. Pat. No. 4,341,501, issued July 27, 1982, Ser. No. 300,183, filed Sept. 8, 1981, and Ser. No. 329,348, filed Dec. 10, 1981 now U.S. Pat. No. 4,389,153, issued June 21, 1983.

BACKGROUND OF THE INVENTION

This invention relates generally to material handling and excavation equipment, and more particularly to an improved hydraulic valving arrangement for the hydraulic boom swinging mechanism of a backhoe.

A conventional backhoe includes an articulated boom mounted on the rear of a tractor or similar piece of equipment and which carries a pivotal bucket for digging operations. The boom is mounted to a swing tower for movement about a vertical axis so that material carried by the backhoe bucket may be moved from one area to another. The swing tower is rotated from side to side by opposed double acting hydraulic motors controlled by a directional control valve manipulated by the backhoe operator.

Backhoes are employed for a wide variety of material handling and excavation operations, and as a result the business is highly competitive in nature. In view of this, any means whereby the work can be more efficiently performed is desirable. One of the ways in which efficiency may be increased is to shorten the time cycle involved in filling the bucket, raising it out of the excavation, swinging the bucket laterally, depositing the material within the bucket on a pile or into a truck, and then returning the bucket to repeat the cycle.

With conventional hydraulic arrangements employed prior to the 1960's for rotating the swing tower of the backhoe, it was the usual practice of operators, in order to save time, to swing the boom and swing tower over hard against the mechanical travel or swing stops provided on the backhoe frame for limiting the arc of swinging movement. This practice was found to be very detrimental because the frame, the swing tower and boom, and the hydraulic circuits were subjected to severe shock loading. While these shocks could be minimized by careful manipulation of the backhoe swing controls, this extra degree of care proved to be time consuming, and thus decreased productivity.

Thus, in order to alleviate this problem while improving the productivity and efficiency of the backhoe, various systems have been devised to decelerate the boom and swing tower prior to hitting the swing stops, even if the backhoe operator does not attempt to reduce the speed of the boom.

One prior method of cushioning movement of the boom and swing tower as they approach the stops at the end of the arc of travel includes substantially blocking the usual flow port from the cylinder end of each hydraulic motor to restrict fluid flow. Flow is blocked by a projection carried by the piston of each of the hydraulic motors. The projection enters and substantially blocks flow in an outlet port as the piston moves within the motor cylinder. Projections such as these are sometimes referred to as "stingers." Although such arrangements are still commonly in use today, their fabrication and maintenance has proven to be relatively expensive.

Another arrangement for providing cushioning for the movement of the boom and swing tower is to include an orifice in the outlet port of the hydraulic motors. In this way, back pressure is created within the hydraulic motors which acts to resist the continued swinging movement of the boom and swing tower. This arrangement is not without its drawbacks, however. The pressure generated by the orifice is continually resisting the swinging movement of the boom and swing tower, even when the backhoe operator is trying to accelerate the swinging movement. This acts to lower the speed of the swinging movement, uses more energy than is necessary to swing the boom, and consequently generates more heat in the hydraulic system. Further, the use of such orifices does nothing to slow or cushion the swing of the boom and swing tower toward the extreme ends of the arc of travel because the oil flow through the orifices is too small to generate sufficient pressure to slow the swinging movement. In view of this, use of orifices in combination with the above-described stingers is not uncommon, but such arrangements are fairly expensive and may be subject to problems during field use.

Another area of backhoe swing mechanism design which has created problems relates to the positioning and hydraulic porting of the hydraulic motors. Part of the versatility of backhoes is derived from their ability to rotate the swing tower and boom through an arc of approximately 180 degrees. Although various arrangements have been tried, spacial limitations have generally required that the hydraulic motors be mounted on the backhoe frame generally parallel to each other and on respective sides of the vertical axis of the swing tower. It will be appreciated, however, that this arrangement creates problems when the swing tower is rotated through the desired arc of travel.

As the swing tower and boom rotate in one direction or the other, from a centrally disposed position, one of the hydraulic motors extends to a fully extended condition which occurs as the centerline of that motor intersects the vertical axis of the swing tower. When this occurs, the motor is frequently referred to as being in its "center" position. As the swing tower continues to rotate toward the travel stop, that motor starts to contract, and is referred to as being in an "overcenter" position or condition.

If the supply of pressurized hydraulic fluid to the hydraulic motors is continued and ported without change as one of the motors goes overcenter, the pressure of the fluid then causes that motor to exert a negative torque on the swing tower and boom. Because of the geometry of the swing tower and the hydraulic motors, the hydraulic motor which has gone overcenter acts upon the swing tower through a lesser moment arm than the other hydraulic motor of the swing mechanism. Consequently, the swing tower continues to move as intended, with the one motor not only rotating the swing tower and boom, but working to overcome the negative torque created by the overcenter hydraulic motor. Thus, a swing mechanism control system which operates to eliminate undesired negative torque created by one of the hydraulic motors in an overcenter configuration as the swing tower and boom are moved provides a more efficient swing mechanism system.

It is particularly desirable to eliminate this negative torque exerted by the overcenter motor as the swing tower and boom are moved away from their travel stop. This improves the net torque applied to the swing tower and boom. Further benefit is derived if the overcenter motor can be ported to provide a supplemental torque to the swing tower and boom which assists the motor providing the primary torque in initiating swinging movement of the mechanism.

Thus, a valving arrangement for a swinging mechanism of a backhoe which acts not only to alleviate the problems of cushioning the boom and swing tower assembly, but also improves the operational characteristics of the assembly, particularly toward the ends of its arc of travel (when one of the hydraulic motors is in an overcenter position), would be extremely desirable.

SUMMARY OF THE INVENTION

The present invention provides a novel valving arrangement for the swing mechanism of a backhoe which performs both cushioning and sequencing functions during swinging movement of the boom. Particularly, the present invention functions to provide hydraulic cushioning of the boom as it approaches its travel stops, while providing relatively unrestricted movement of the boom when hydraulic restriction of the movement is not desirable. While the present invention is disclosed in association with a backhoe, it will be understood, however, that the present invention would be equally suitable for use in rotating a pivotally movable member through an arc by the conversion of rectilinear motion to rotational motion, and where the operational characteristics provided by the subject invention are desired.

With reference to application in a backhoe, two hydraulic motors are used to rotate the swing tower which supports the boom of the backhoe for swinging movement about a vertical pivot axis. The swing tower is pivoted about the vertical axis on a backhoe support stand or frame, which in turn is typically attached to a tractor. Each of the hydraulic motors is pivotally interconnected with the frame and the swing tower. The hydraulic system the tractor supplies fluid under pressure to actuate the hydraulic motors. A flow control valve, which is manipulated by the operator of the backhoe, selectively directs fluid under pressure to the hydraulic motors in order to rotate the swing tower with respect to the frame. The position of the flow control valve determines the direction of flow of the pressurized hydraulic fluid to the hydraulic motors for selective swinging movement of the boom and swing tower.

In accordance with the present invention, a sequencing valve and hydraulic cushioning circuit are hydraulically joined with an end of each of the two hydraulic motors and the flow control valve. The sequencing valve includes a valve body having an axial bore and a valve spool disposed within the bore and shiftable therein. The position of the valve spool within the valve body is adapted to be altered by a control mechanism which operatively associates the sequencing valve with the swing tower of the backhoe. In this way, the position of the valve spool is a function of the position of the swing tower and boom relative to the frame of the backhoe. The result achieved by this is that the valve spool may be repositioned within the valve body of the sequencing valve at desired portions of the arc of travel of the swing tower and boom of the backhoe.

In view of the physical arrangement of the hydraulic motors with respect to the backhoe frame and swing tower, it is usually desirable that hydraulic fluid supplied to the hydraulic motors be redirected generally as either of the motors moves into or out of its overcenter configuration. Thus, the operating mechanism for the sequencing valve provides this result, and enables hydraulic fluid to be directed by the sequencing valve for improved operational characteristics of the hydraulic motors as the swing tower is moved about its vertical axis.

The sequencing valve provides improved operational and torque characteristics during the swinging movement of the swing tower and boom by directing hydraulic fluid to the hydraulic motors in the following way. If it is assumed that the swing tower of the backhoe is to be moved from one extreme position in its arc of travel to the other, one of the hydraulic motors is ported to provide the primary torque or motive force to the swing tower, while the other, overcenter hydraulic motor, is ported to provide supplementary or additional torque. Because this second motor is in its overcenter condition when the swing tower is positioned at the end of its travel, this motor is less than fully extended at the beginning of the arc of travel of the swing tower and boom. As the swing tower is rotated from the end of its travel, this second hydraulic motor first extends or expands until it is fully extended, this condition taking place as the longitudinal centerline of the hydraulic motor intersects and passes through the vertical axis of the swing tower. The point of intersection represents the "center" position of that hydraulic motor.

So that the motor which is in its overcenter condition may supply additional torque through the swing tower as it is moved from the end of its arc of travel, the sequencing valve of the subject invention directs pressurized hydraulic fluid to *both* sides of the piston of that hydraulic motor. Because the effective area against which the pressurized hydraulic fluid acts is greater on the cylinder or head end of the hydraulic motor than the area of the piston rod end of the hydraulic motor, a supplementary torque is applied to the swing tower by this motor as it moves out of its overcenter condition. The other hydraulic motor, which is not in an overcenter condition and is extending from its fully contracted position, provides the primary torque or motive force for pivoting the swing tower away from the end of its arc of travel. In this way, the motor providing the primary motive force does not work to overcome a negative torque produced by the overcenter motor, as would tyopically be the case in a conventionally ported system.

As the swing tower rotates and the hydraulic motor supplying the supplementary torque moves from its overcenter condition through its center position, a sequencing valve operating mechanism, which provides positional feedback from the swing tower to the sequencing valve, shifts the valve spool within the sequencing valve, thus resulting in the redirection of hydraulic fluid to the hydraulic motors. In essence, the redirection of the hydraulic fluid is such that pressurized hydraulic fluid is then supplied to opposite ends of the motors, neither of which is then overcenter. The motors respectively expand and contract as the swing tower is moved through the central portion of its arc of travel, each supplying motive force to the swing tower and boom.

As the swing tower and boom of the backhoe continue to rotate, the other of the hydraulic motors approaches its overcenter configuration. As this motor moves through its center position and goes overcenter, the sequencing valve operating mechanism again shifts the valve spool of the sequencing valve, and the direction of pressurized hydraulic fluid to the hydraulic motors is again altered. The repositioning of the sequencing valve as one of the motors moves into its overcenter condition redirects the hydraulic fluid such that only the other (non-overcenter) motor applies motive force to the swing tower. Significantly, the cylinder ends of the motors are in fluid communication through the sequencing valve as either of the motors goes overcenter. This provides the desired improvement in the torque characteristic of the swing mechanism, and also greatly facilitates cushioning of the mechanism.

In order to prevent excessive shock to the frame, swing tower and boom, and hydraulic system of the backhoe, the present invention provides a hydraulic cushioning circuit operatively associated with the sequencing valve. In the preferred embodiment, the cushioning circuit is incorporated into the body of the sequencing valve, but it will be appreciated that other arrangements would operate in a like fashion. This circuit is arranged such that the flow of hydraulic fluid which is being discharged from both of the hydraulic motors as the swing tower and boom approach the end of their travel is restricted. A flow restricting, orificed relief valve and an orifice are arranged in parallel flow relation in the cushioning circuit such that hydraulic cushioning is only effected during rotation of the boom through the ends of its arc of travel toward the travel stops. The orifice in the hydraulic circuit permits fluid flow through the circuit when flow from the hydraulic motors is insufficient to open the relief valve.

The hydraulic cushioning circuit also includes a check valve arranged in parallel with the relief valve and orifice. The check valve is disposed to substantially eliminate hydraulic restriction of the swing tower and boom as they move away from the ends of their travel. This substantially eliminates excessive restriction and back pressure when the operator of the backhoe is attempting to accelerate the swinging movement of the swing tower and boom away from the travel stop. This hydraulic cushioning circuit is a significant improvement over currently used designs in that it is no longer necessary to provide each hydraulic cylinder with a restricting orifice and "stinger" as is commonly done in current practice. Additionally, since flow from both hydraulic motors is directed to the cushioning circuit to effect cushioning, the peak cushioning back pressure created is less than the peak pressure which is created in cushioning a swing mechanism in which fluid flow from only one of the hydraulic motors is restricted, such as in a conventional "stinger" arrangements.

Thus, the present invention provides an improved hydraulic switching and valving arrangement for the swing mechanism of a backhoe or other suitable implement which improves the operational characteristics of the hydraulic operation of the implement and provides necessary hydraulic cushioning for preservation of the implement.

DESCRIPTION OF THE PREFERRED EMBODIMENT

Figure 1:
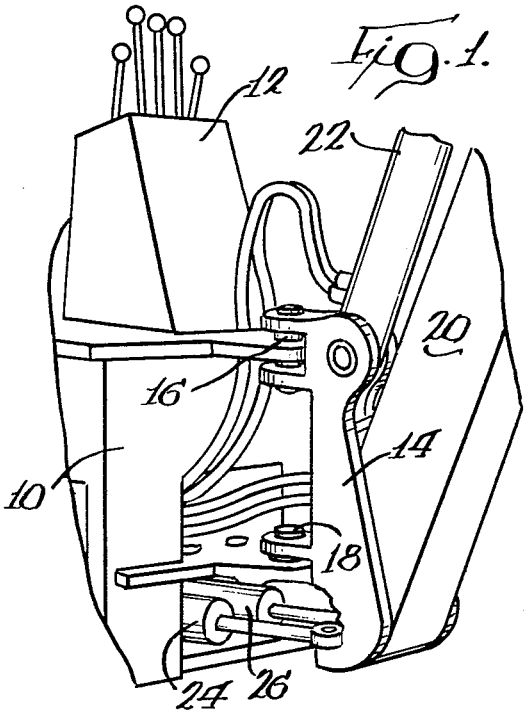
FIG. 1 is a partial perspective view of a backhoe showing the control area, boom swing tower, and swing mechanism.

While the present invention is susceptible to embodiment in different forms, there is shown in the drawings and will hereinafter be described preferred and alternate embodiments with the understanding that the present disclosure is to be considered as an exemplification of the principles of the invention and is not intended to limit the invention to the embodiments illustrated.

With reference now to FIG. 1 and FIGS. 3A–3C, therein is illustrated a portion of an articulated backhoe. The backhoe includes a frame 10 which is suitably supported on a tractor or other similar piece of equipment (not shown). The backhoe includes a control area 12 where an operator manipulates controls for articulation of the backhoe. Attached to the frame 10 is a mast or swing tower 14 which is pivoted for movement with respect to the frame 10 about a vertical axis defined by upper pivot 16 and lower pivot 18. The swing tower 14 supports backhoe boom 20 which is movable about a horizontal axis with respect to the swing tower 14 by a double acting hydraulic motor or fluid ram 22.

Movement of the swing tower and the boom with respect to the frame 10 is provided by a pair of double acting hydraulic fluid motors 24 and 26. Each of the hydraulic motors 24 and 26 respectively include a fluid cylinder 28 and 30, and a fluid piston 32 and 34 movable within the respective cylinder in response to pressurization by hydraulic fluid. Each of hydraulic motors 24 and 26 are mounted to the frame 10 of the backhoe by cylinder pivots 36 and 38, respectively. The piston 32 and 34 of each of hydraulic motors 24 and 26 is respectively pivotally connected with the swing tower 14 of the backhoe, whereby rectilinear motion of the piston rods within the cylinders of the hydraulic motors 24 and 26 provide rotation of the swing tower 14 about upper and lower pivots 16 and 18.

Figure 3A:
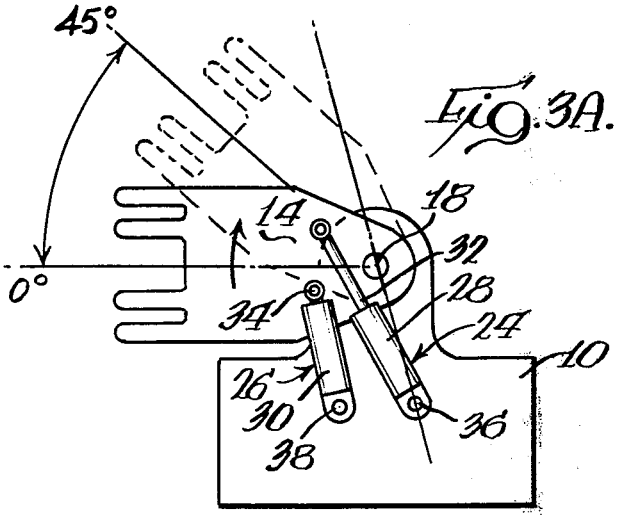
FIGS. 3A–3C illustrate the orientation of the swing mechanism hydraulic motors which pivot the swing tower of the backhoe as the swing tower is moved from one end of its arc of travel to the other.
Figure 3B:
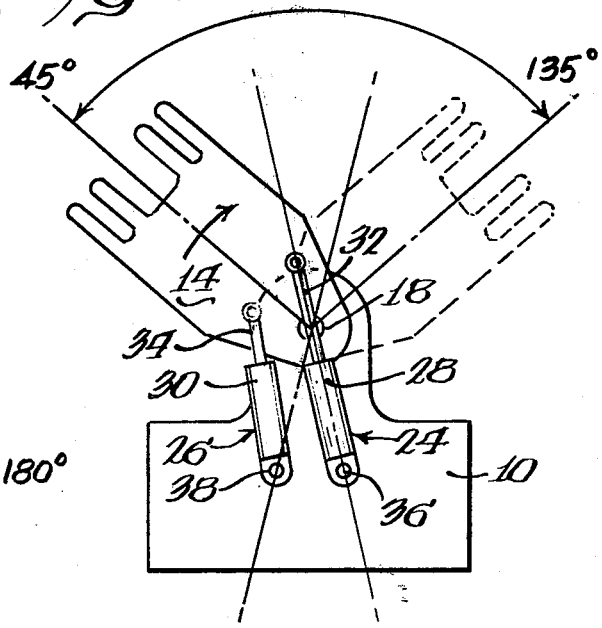

With further reference to FIGS. 3A–3B, the orientation of the hydraulic motors 24 and 26 with respect to the frame 10 and the swing tower 14 is illustrated as the swing tower 14 is pivoted through its arc of travel. As shown, this arc of travel is approximately 180 degrees, although it will be understood by those familiar with the art that the arc of travel may be greater than or less than this. Pressurized hydraulic fluid supplied to the hydraulic motors 24 and 26 provide expansion and contraction of the hydraulic motors such that the swing tower 14 is moved about its vertical swinging axis. This axis extends vertically through lower pivot 18 shown in FIGS. 3A–3C.

It will be understood that when either of the longitudinal centerlines of the hydraulic motors 24 and 26 intersects the vertical pivot axis of the swing tower 14, that motor is at its maximum extension. This configuration is commonly referred to as the center position for that hydraulic motor. If the swing tower 14 and the boom 20 move from the central portion of their arc of travel toward either of the ends of the arc, one of the hydraulic motors 24 and 26 goes through its center position. As the swing tower 14 continues to be rotated, the hydraulic motor which has moved through its center position will begin to contract, and that hydraulic motor is then in its overcenter condition or configuration.

Significantly, as one of the hydraulic motors moves to and through its center position, the torque exerted by that hydraulic motor on the swing tower 14 approaches zero. If the porting of pressurized hydraulic fluid to that hydraulic motor is not altered, it would then apply a negative torque to the swing tower as it goes overcenter. Because the moment arm through which the other (non-overcenter) hydraulic motor reacts on the swing tower 14 is greater than the moment arm through which the overcenter hydraulic motor acts upon the swing tower 14, the negative torque would be overcome and the swing tower 14 and the boom 20 would continue to rotate. Clearly, it is desirable to alter the porting of the overcenter hydraulic motor so that, in essence, the hydraulic motors are not working against each other. The characteristics of the torque applied to the swing tower 14 are further improved if the hydraulic motor which is in its overcenter condition is ported to provide supplemental torque for rotating the swing tower 14 and the boom 20 as they move away from the end of their arc of travel, thereby improving the control and efficiency with which the boom 20 is rotated.

As shown in FIG. 3A, the swing tower 14 is illustrated as being at one end of its arc of travel. In this position, hydraulic motor 26 is shown as being fully contracted, and provides the primary motive force for rotating the swing tower 14 (and the boom 20, not shown) when pressurized hydraulic fluid is ported to the cylinder end thereof. Hydraulic motor 24 is shown in its overcenter condition.

As the swing tower 14 is rotated to the position shown in phantom in FIG. 3A, hydraulic motor 24 extends until it reaches its center position wherein its longitudinal centerline intersects the vertical swinging axis (defined by pivot 18) of the swing tower 14.

With reference now to FIG. 3B, the swing tower 14 is shown being moved through the central portion of its arc of travel, approximately 90 degrees. Hydraulic motor 24 moves through its center position, as shown, and then begins to contract as hydraulic motor 26 continues to extend. Opposite ends of the hydraulic motors 24 and 26 are supplied with hydraulic fluid under pressure, with each contributing motive power for the rotation of the swing tower 14 and the boom 20.

Figure 3C:
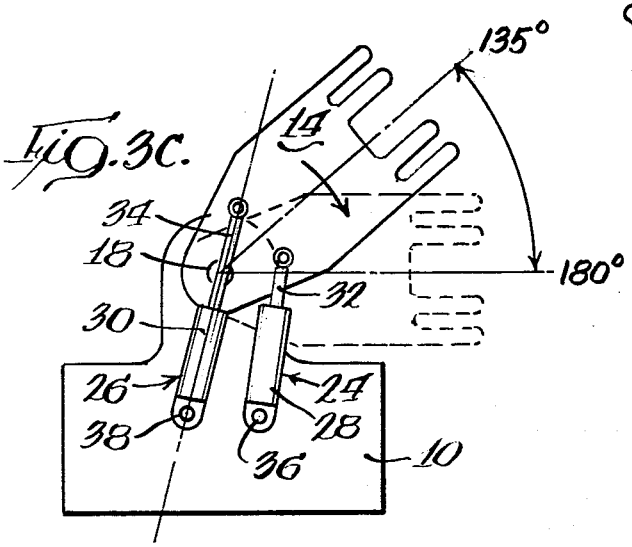

As the swing tower 14 is further rotated to the position illustrated in FIG. 3C, it will be observed that hydraulic motor 26 moves into its center, fully extended position as its longitudinal centerline passes through the vertical swinging axis of the swing tower 14. Further rotation of the swing tower 14 to the position shown in phantom in FIG. 3C causes hydraulic motor 26 to go into its overcenter condition, wherein it is less than fully extended.

It will be appreciated that the hydraulic motors 24 and 26 go through three distinct operational phases as the swing tower 14 is rotated clockwise from one extreme of its arc of travel to the other. In the first phase, hydraulic motor 26 provides the primary motive force for applying torque to the swing tower 14, and hydraulic motor 24 is in its overcenter condition (FIG. 3A). In the second phase (FIG. 3B) neither of the hydraulic motors 24 and 26 is in its overcenter condition, and each apply force to the swing tower 14 for moving the swing tower 14 and the boom 20. In the third phase (FIG. 3C) hydraulic motor 26 moves into its overcenter condition, while the hydraulic motor 24 provides the primary motor force for the rotation of the swing tower 14. The hydraulic fluid flow and porting provided by the present invention will hereinafter be described with respect to each of these operational phases as the swing tower and boom are moved in clockwise and counterclockwise directions.

Figure 2:
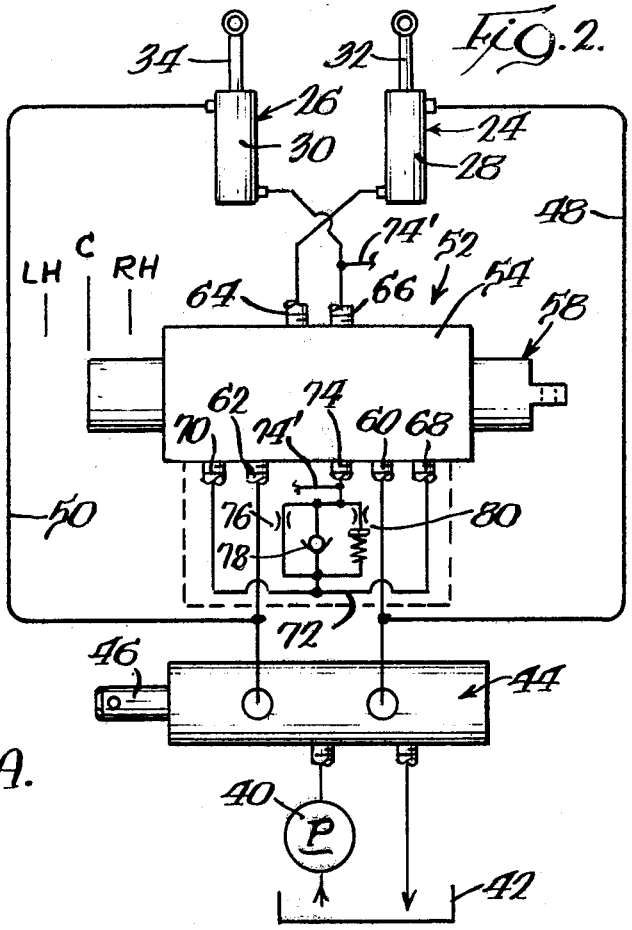
FIG. 2 is a diagrammatic view of the hydraulic control circuit and swing mechanism of the present invention shown in conjunction with the backhoe illustrated in FIG. 1.

In accordance with the present invention, FIG. 2 illustrates the hydraulic valving and circuit arrangement for supplying hydraulic fluid to each of the hydraulic motors 24 and 26. The hydraulic system includes a pump (P) 40 which delivers hydraulic fluid under pressure from a fluid reservoir or sump 42. The hydraulic pump 40 delivers pressurized hydraulic fluid to a directional flow control valve 44 which typically includes a valve spool 46 which is operatively connected with a control mechanism through which the operator of the backhoe may selectively direct the flow of hydraulic fluid to the hydraulic motors 24 and 26. Control valve 44 includes two outlets which are respectively connected with the piston rod ends of hydraulic motors 24 and 26 by conduits 48 and 50.

Figure 4A:
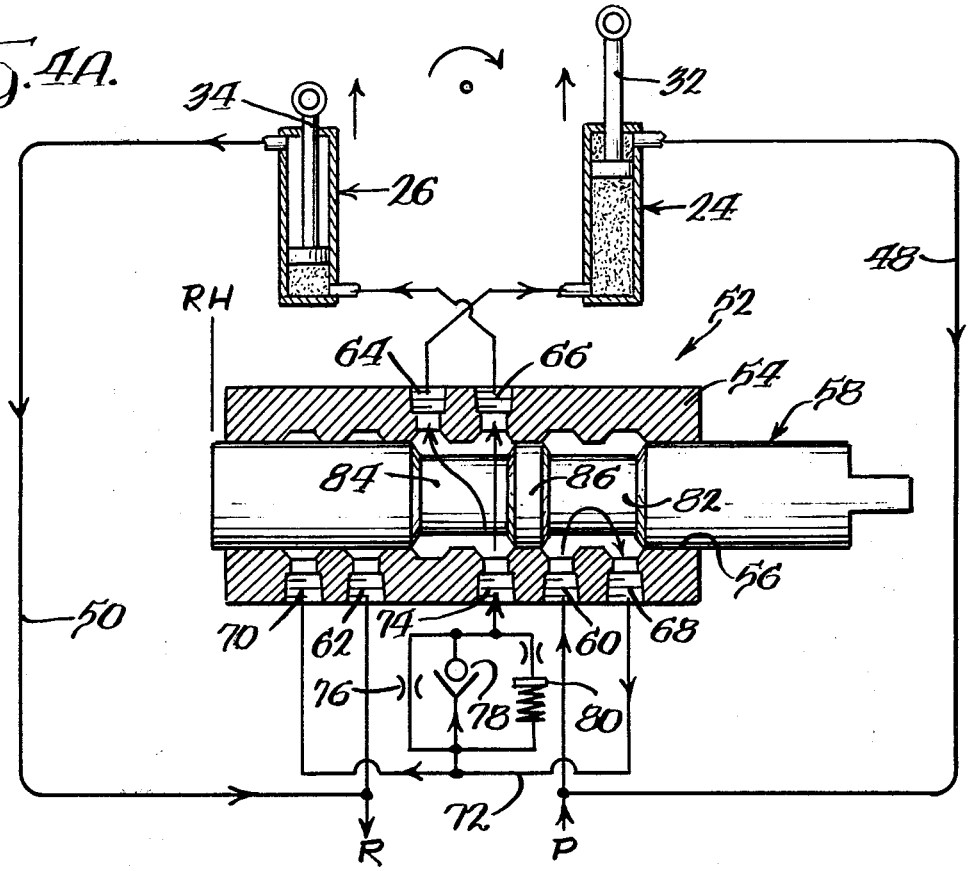
FIGS. 4A–4C are diagrammatic cutaway views illustrating the operation of the hydraulic control circuit of the present invention as the hydraulic motors of the backhoe pivot the swing tower in a clockwise direction.

The hydraulic system further includes a sequencing valve 52. As shown in FIGS. 2 and 4A, sequencing valve 52 includes a valve body 54 which defines therein an axial bore 56. A valve spool 58 is slidably disposed within the axial bore 56, and is movable with respect to the valve body 54 between a left hand (LH), a right hand (RH), and a center (C) position. The valve body 54 is provided with suitable seals (not shown) at the ends thereof for sealingly engaging the valve spool 58 so that leakage of pressurized hydraulic fluid from the interior of the valve 52 is prevented. The valve spool and housing cooperate to control the flow of fluid to the cylinder ends of hydraulic motors 24 and 26.

The valve body 54 defines a plurality of fluid flow valve passages which are in fluid flow communication with the axial bore 56 of the valve body 54. First and second valve passages 64 and 66 are respectively connected by suitable conduits with the cylinder ends of the hydraulic motors 24 and 26. Third and fourth valve passages 60 and 62 are respectively connected in fluid flow communication with control valve 44 by conduits 48 and 50. A pair of fifth and sixth valve passages 70 and 68 are in flow communication with each other by means of a conduit 72. In the preferred embodiment conduit 72 is defined by the valve body 54, as indicated by phantom line in FIG. 2.

The sequencing valve 52 is hydraulically joined with a flow restricting hydraulic cushioning circuit. A passage 74 provides fluid flow communication between the circuit and motors 24 and 26. While passage 74 is illustrated as adjacent bore 56 for purposes of clarity, the preferred embodiment of the invention contemplates that a passage 74' (illustrated schematically in FIG. 2) is instead provided which communicates with one of passages 64 or 66, to provide fluid communication between the cylinder ends of motors 24 and 26 and the cushioning circuit. Even though passage 74' communicates directly with only one of passages 64 and 66 (and thus directly communicates with only one cylinder end of the motors), fluid communication between the cylinder ends of the motors is selectively provided by valve 52, as will be described, to provide communication of each motor with the cushioning circuit. Naturally, various arrangements may be provided so that communication is provided between the motors and the hydraulic cushioning circuit in the intended manner.

The hydraulic cushioning circuit includes, arranged in parallel flow relation, a flow restricting orifice 76, a one-way check valve 78, and a flow restricting relief valve 80 which includes an orifice and pressure responsive relief valve in series. Each of the orifice 76, check valve 78 and relief valve 80 are in flow communication with the conduit 72 connecting valve passages 68 and 70. As will be more fully described, during operation check valve 78 functions to permit substantially unrestricted fluid flow from either of flow passages 68 or 78, via conduit 72, through the cushioning circuit to flow pasage 74. As indicated by phantom line in FIG. 2, the preferred embodiment of the present invention contemplates that the cushioning circuit be provided within the body 54 of valve 52.

Valve spool 58 of the sequencing valve 52 defines a pair of recessed portions 82 and 84 between which is disposed a circumferential land 86. Thus, repositioning of the valve spool 58 within the valve body 54 provides selective fluid flow communication between at least two of the various valve passages defined by the valve body 54.

Although not shown, land 86 of spool 58 preferably defines one or more metering grooves. Metering grooves are typically provided in spool valves to reduce peak fluid pressures which result from repositioning of the spool within the valve body, by providing transitional periods between operational positions of the valve. In the present invention, the inclusion of metering grooves on land 86 provides enhanced flexibility in the operational characteristics of the swing mechanism, as will be described.

An arrangement for repositioning the valve spool 58 within the valve body 54 of the sequencing valve 52 may be any one of a number of mechanisms. For instance, the valve spool 58 may be operatively associated with a fluid motor or electrical solenoid, the activation of which could be provided by contact switches or other suitable means engageable by the swing tower 14 of the backhoe. Similarly, a mechanical linkage arrangement, such as described in commonly assigned U.S. Pat. No. 3,872,285, issued to A. G. Short, could also provide control function whereby the position of the valve spool 58 is a function of the position of the swing tower 14 and the boom 20 of the backhoe. The operation of such arrangements will be understood by those familiar with the art.

The present inventiom contemplates that the valve actuating mechanism will function to continuously reposition valve spool 58 between either its right-hand and left-hand positions and its center position as either one of motors 24 and 26 is overcenter (i.e. the actuating mechanism continuously moves the spool during movement of the boom through end portions of its arc of travel). When the boom moves through the central portion of its arc of travel when neither motor 24 or 26 is overcenter, valve spool 58 remains in its center position.

In the present disclosure, the valve spool 58 will be discussed as being shifted or repositioned by such an operating mechanism when either of the hydraylic motors 24 and 26 generally moves through its center position with respect to the swinging axis of the swing tower 14 and boom 20. In this way, the flow of pressurized hydraulic fluid to the hydraulic motors 24 and 26 may be altered as boom swing mechanism moves through its different operational phases. However, it will be understood that the portions of the arc of travel of the swing tower 14 and the boom 20 during which the valve spool 58 is repositioned is a matter of design choice depending upon the exact nature and components of the system used and the desired operational characteristics.

OPERATION

The operation of the present hydraulic system and the improved operational characteristics achieved thereby will now be discussed in detail. FIGS. 4A–4C and 5A–5C illustrate this operation, with the reference characters R and P respectively designating the selective connection of the hydraulic circuit with the reservoir and pump of the hydraulic system through control valve 44 (not shown).

Figure 4B:
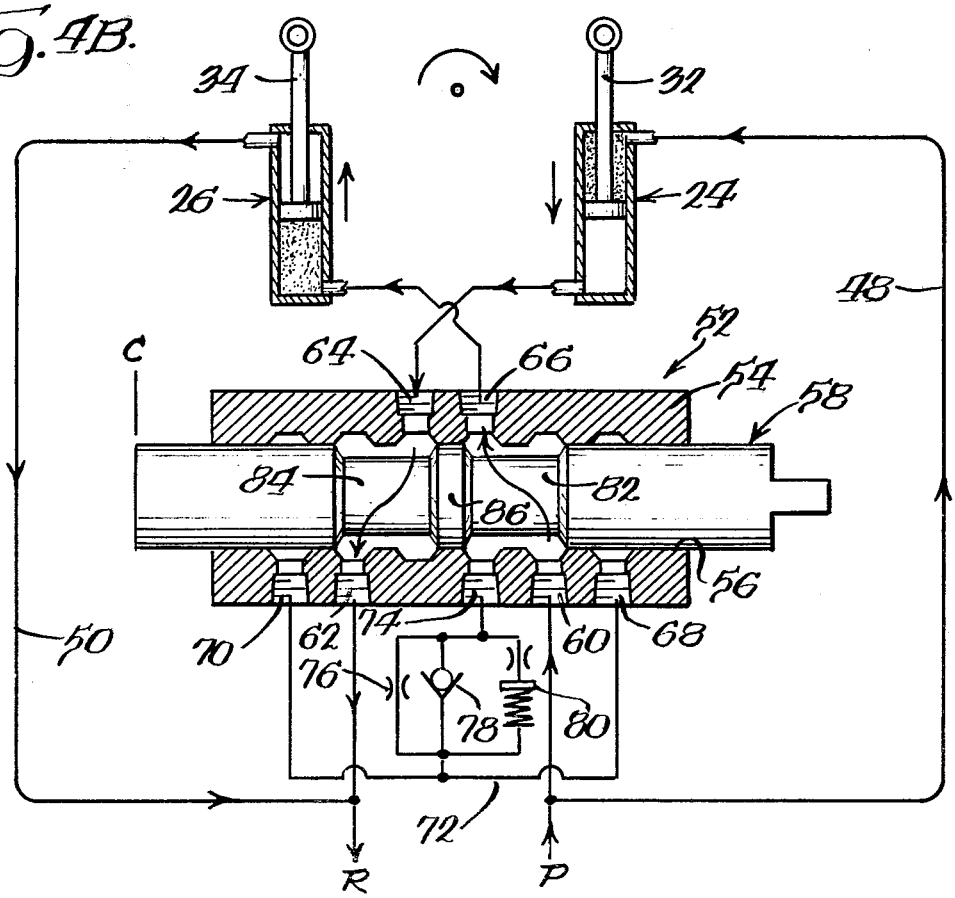
Figure 4C:
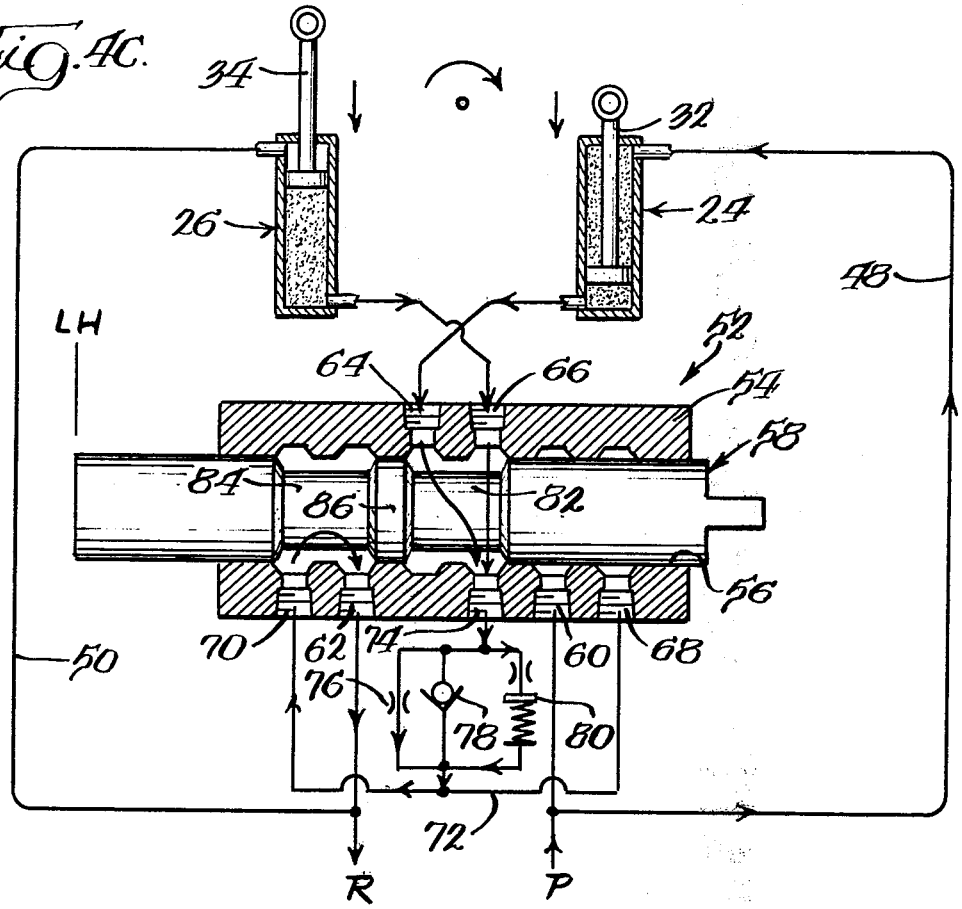

With reference to FIGS. 4A–4C, the operation of the hydraulic motors 24 and 26 by the hydraulic system will be described as the swing tower and boom are rotated clockwise from their extreme left hand position (see FIG. 3A) to their extreme right hand position (see FIG. 3C, phantom).

With particular reference to FIG. 4A, the arrangement of the hydraulic system is illustrated for moving the swing tower 14 clockwise away from the end of its arc of travel. In this position, hydraulic motor 26 provides the primary force for rotating the swing tower 14 and the boom 20 by pressurization of the cylinder end of motor 26, while the hydraulic motor 24 is in its overcenter condition.

As discussed, it is desirable to provide supplementary torque to the swing tower 14 so that hydraulic motor 26 may be assisted in starting the rotation of the swing tower and boom. This is accomplished by pressurizing both sides of hydraulic motor 24. Because the area of the piston on the cylinder end of the hydraulic motor 24 is greater than the area of the piston on the piston rod end of that motor, pressurization of both sides of the hydraulic motor results in the motor applying supplemental force to swing tower 14 to assist motor 26 (which supplies the primary motive force to the swing tower) in pivoting the swing tower and boom. This is accomplished by the positioning of valve spool 58 of the sequencing valve 52 in its right hand position, as illustrated in FIG. 4A. Arrows indicate the direction of flow of hydraulic fluid within the system. High pressure fluid is delivered to the system from the control valve 44 (not shown) indicated at P. Pressurized hydraulic fluid is supplied to the conduit 48 and valve passage 60 in the valve body 54 of the sequencing valve 52.

Because of the positioning of valve spool 58 within the valve body 54, valve passages 60 and 68 are in fluid flow communication, as indicated. Thus, pressurized hydraulic fluid flows from valve passage 68 into conduit 72 from where it flows into the hydraulic cushioning circuit and through the check valve 78. Check valve 78 permits relatively unrestricted flow through the cushioning circuit which substantially bypasses the flow restricting orifice 76 and relief valve 10. Fluid flow through the orifice 76 is negligible relative to the flow through the check valve 78. Pressurized fluid then is directed into valve passage 74 which is in fluid flow communication with valve passages 64 and 66, which are in communication which each other across the recessed portion 84 of the valve spool 58. In this way, pressurized hydraulic fluid is supplied to the cylinder ends of both of the hydraulic motors 24 and 26, flow through the cushioning circuit to the motors being substantially unrestricted.

As shown in FIG. 4A, the piston rod end of the hydraulic motor 26 is in flow communication through conduit 50 with the reservoir of the hydraulic system (R). It should be noted that although high pressure fluid has been provided within conduit 48 connected with the piston end of hydraulic motor 24, flow of fluid within conduit 48 is away from the piston rod end of the hydraulic motor 24, since motor 26 supplying primary motive force to swing tower 14 pivots the swing tower and boom clockwise, resulting in outward movement of piston 32 of motor 24 (which is overcenter).

Thus, as the piston rod end of motor 24 is pressurized through conduit 48, sequencing valve 52 directs fluid under pressure to the cylinder ends of motors 24 and 26 by providing fluid communication between the cylinder ends of the motors, and between the piston rod and cylinder ends of motor 26 across the cushioning circuit. Hydraulic motor 26 provides the primary force for rotating the swing tower 14 away from the end of its arc of travel, while hydraulic motor 24 supplies supplementary force to the swing tower 14. Because hydraulic motor 24 is in its overcenter condition as illustrated in FIG. 4A, both of the piston rods 32 and 34 of the hydraulic motors 24 and 26 would move outwardly thereof, as indicated by the arrows.

With reference now to FIG. 4B, the hydraulic system of hydraulic motors 24 and 26 are illustrated as the swing tower 14 is moved through the central portion of its arc of travel. This range of motion is illustrated in FIG. 3B. During this portion of the arc of travel of the swing tower 14, each of the hydraulic motors 24 and 26 is in a non-overcenter condition, with hydraulic motor 24 contracting while hydraulic motor 26 is extending. As hydraulic motor 24 moves from its overcenter condition through its center position, the operating mechanism for positioning the valve spool 58 shifts the valve spool to its center position with respect to the valve body 54 to redirect the flow of fluid to the motors. In this configuration, pressurized fluid is supplied to opposite ends of motors 24 and 26 by fluid communication between the piston rod end of motor 24 and the cylinder end of motor 26 via sequencing valve 52. Valve 52 also provides communication between the cylinder end of motor 24 and the piston rod end or motor 26 for return of fluid to the system reservoir.

Pressurized fluid is supplied from P to conduit 48 and valve passage 60. The conduit 48 supplies pressurized fluid to the piston rod end of hydraulic motor 24, while pressurized fluid directed to valve passage 60 flows across recessed portion 82 of the valve spool 58, and through valve passage 66 to the cylinder end of hydraulic motor 26. The cylinder end of hydraulic motor 24 is in flow communication through valve passages 64 and 62 with the reservoir of the hydraulic system, as is the piston rod end of hydraulic motor 26 through conduit 50. Thus, the swing tower and boom of the backhoe are swung about their vertical axis as hydraulic motor 24 contracts and hydraulic motor 26 expands by pressurization of the piston rod end of motor 24 (form control valve 44, not shown in FIG. 4B), and the direction of fluid under pressure to the cylinder end of motor 26 by sequencing valve 52. It will be observed that the hydraulic cushioning circuit in flow communication with valve passage 74 and conduit 72 is in fluid flow isolation, since the cushioning effect provided thereby is not required during movement of the swing tower and boom through the central portion of their arc of travel.

With reference now to FIG. 4C, the hydraulic system is illustrated after hydraulic motor 26 has passed through its center position and has gone overcenter (see FIG. 3C). During swinging movement of the swing tower and boom through the end portion of their arc of travel toward their travel stop, hydraulic cushioning is desired to prevent excessive shock loading of the backhoe frame, boom and swing tower and hydraulic system.

Full hydraulic cushioning can be provided at the time of motor 26 going overcenter, or somewhat later. Since cushioning slows the movement of the swing tower and boom, it is desirable to delay the cushioning affect somewhat after motor 26 goes overcenter so that relatively unrestricted movement is not unnecessarily affected. Previously described metering grooves are preferably provided on land 86 of spool 58 to provide a transitional period during which some flow of fluid is permitted to bypass the hydraulic cushioning circuit until full flow restricting cushioning is desired. Spool 58 may be shifted toward the left hand position, as shown in FIG. 4C, as motor 26 goes overcenter, with full cushioning effected sometime after that as the continued shifting of the valve spool by the operating mechanism operatively connecting the spool with the swing tower closes the metering grooves. For example, full cushioning may be effected during the final 30–35 degrees of rotation of the swing tower and boom toward their travel stop. Of course, the exact timing of hydraulic cushioning is a matter of design choice, with consideration given to the inertical characteristics of the boom assembly.

As shown in FIG. 4C, pressurized hydraulic fluid is supplied through conduit 48 to the piston rod end of hydraulic motor 24. Because of the position of the valve spool 58 within the valve body 54, valve passages 64 and 66 are in fluid flow communication across recessed portion 82 of the valve spool 58, with valve passage 74 in communication with passages 64 and 66. Fluid flowing from the cylinder ends of both hydrauic motors 24 and 26 is directed to valve passage 74 and the hydraulic cushioning circuit. Thus, the sequencing valve 52 provides fluid communication between the cylinder ends of the motors, and between the cylinder end of motor 26 and the piston rod end of motor (ported to the system) reservoir) across the cushioning circuit.

The arrangement of the cushioning circuit acts to provide desired hydraulic cushioning under different operating conditions. Flow into the circuit initially passes through orifice 76 as back pressure in the circuit increases. When the back pressure reaches a predetermined value, on the order of 800 pounds per square inch (p.s.i.) for example, relief valve 80 opens to permit fluid flow therethrough. Because valve 80 includes an orifice, a further increase in volumetric flow results in a further increase of cushioning back pressure even though the relief valve is open. The cushioning circuit may create back pressure as high as 3000–3500 p.s.i. in order to adequately cushion the swing mechanism. "Tuning" of the cushioning circuit to accommodate use of different implements on the backhoe boom may be readily effected by changing the size of orifice 76, by adjusting relief valve 80 where it is adjustable in nature, or by changing the orifice size of relief valve 80.

It will be appreciated that peak cushioning back pressure with the cushioning circuit is less than peak pressure typically needed to cushion swinging movement of a boom in which flow from only one of its swing motors is restricted, since cushioning is effected in the present system by restricting flow from both motors 24 and 26. Clearly, this is a significant improvement over previously known arrangements. While the provision of an orifice and an orificed relief valve in parallel with a check valve is the preferred arrangement for the cushioning circuit, many of the desirable operational characteristics of the present system may be achieved by providing an orifice or equivalent flow restrictor in parallel with a check valve, without a pressure responsive relief valve.

Notably, orifice 76 permits fluid flow through the cushioning circuit even though flow may be insufficient to open relief valve 80, as may be the case during certain operating conditions of the backhoe. For instance, if the boom of the backhoe is stopped such that one of the hydraulic motors 24 and 26 is in its overcenter condition, and the boom then further moves toward the end of its arc of travel, the flow from the cylinder ends of the hydraulic motors 24 and 26 to the cushioning circuit may be insufficient to create sufficient pressure for the activation of relief valve 80.

Fluid flow from the cushion circuit is directed through conduit 72, and through valve passages 70 and 62 across recessed portion 84 of the valve spool 58. The hydraulic fluid then flows to the reservoir of the hydraulic system. It will be appreciated that although hydraulic flow is flowing into the piston rod end of hydraulic motor 26 since this motor is in its overcenter condition and its piston rod 34 is moving inwardly as hydraulic motor 24 rotates the swing tower and boom, there is essentially no motive force applied to the swing tower by motor 26 as the swing tower and boom are moved to the end of their arc of travel. Instead, motor 26 provides hydraulic cushioning of the swing tower and boom since fluid flow from its cylinder end (together with fluid flow from the cylinder end of motor 24) is restricted by the cushioning circuit.

Thus, as the swing tower 14 and boom 20 are rotated left to right, the hydraulic system cycles through its three operational phases. As pressurize the piston rod end of motor 24, sequencing valve 52 concurrently and sequencially directs pressurized fluid: first to the cylinder ends of both motors 24 and 26 (FIG. 4A), then to the cylinder end of motor 26 (FIG. 4B), and then to neither of the cylinders ends of the motors (FIG. 4C). As the swing tower and boom approach their travel stop, fluid flow from the cylinder ends of the motors is restricted by being directed through the hydraulic cushioning circuit.

Figure 5A:
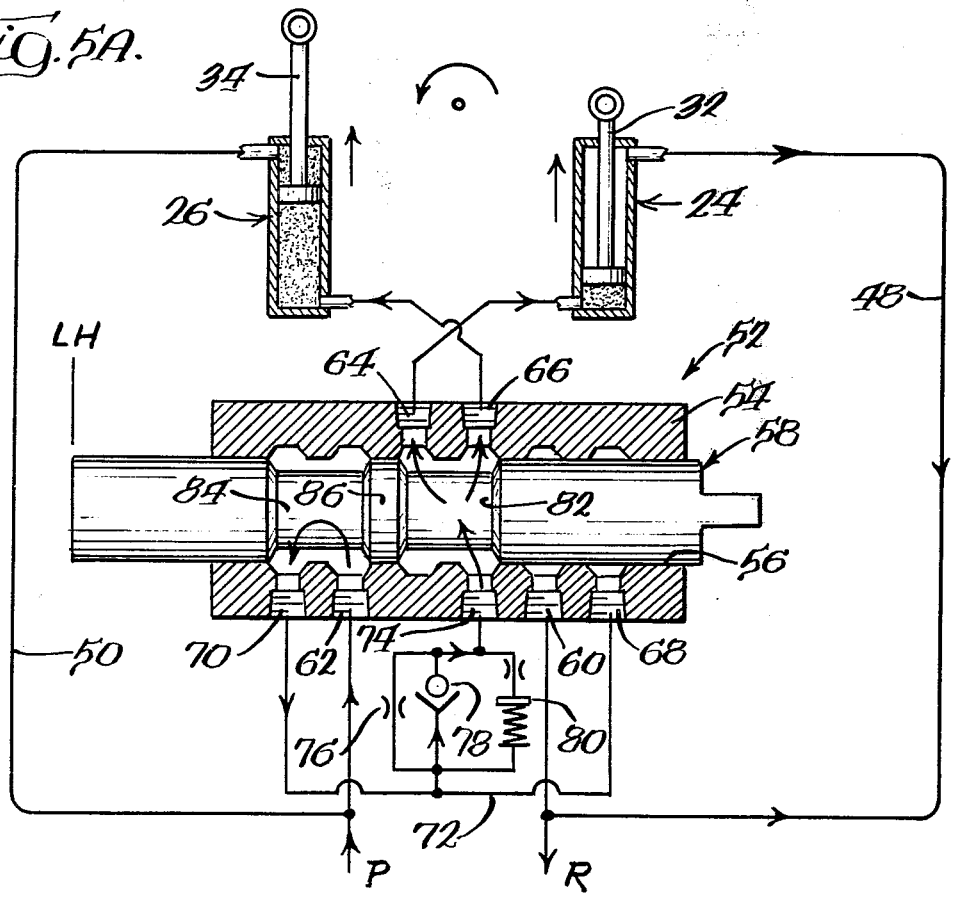
FIGS. 5A–5C are diagrammatic cutaway views illustrating the operation of the hydraulic control circuit of the present invention as the hydraulic motors of the backhoe pivot the swing tower in a counterclockwise direction.
Figure 5B:
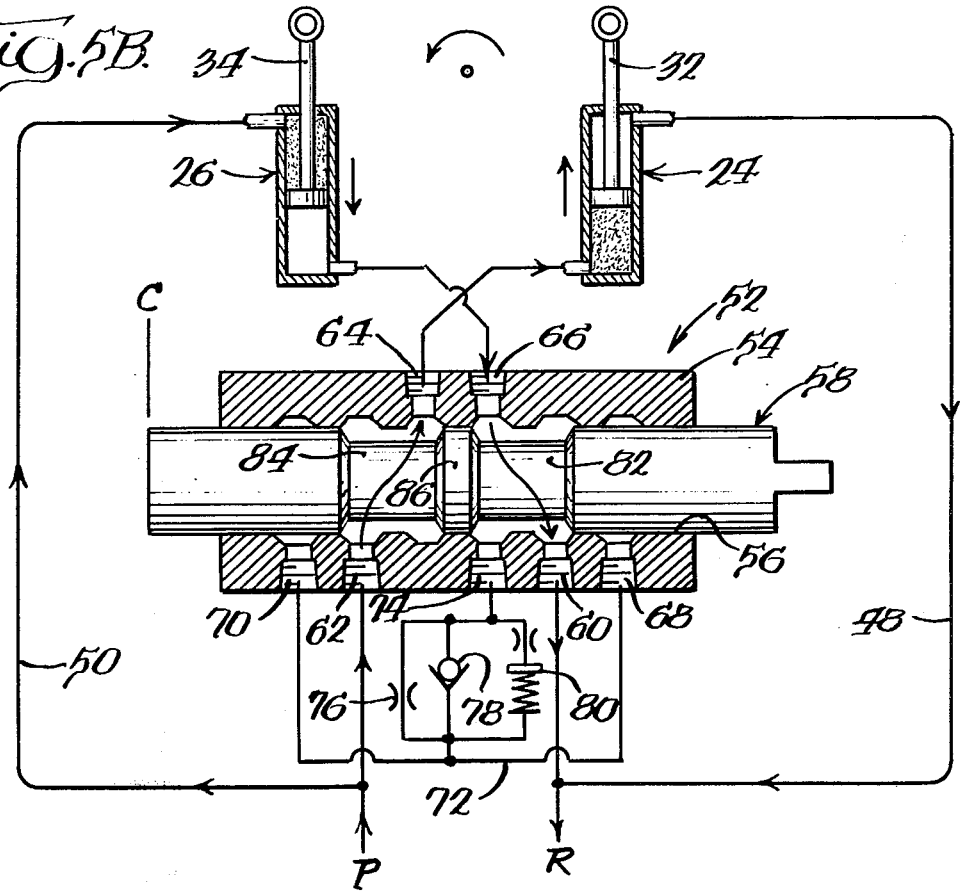
Figure 5C:
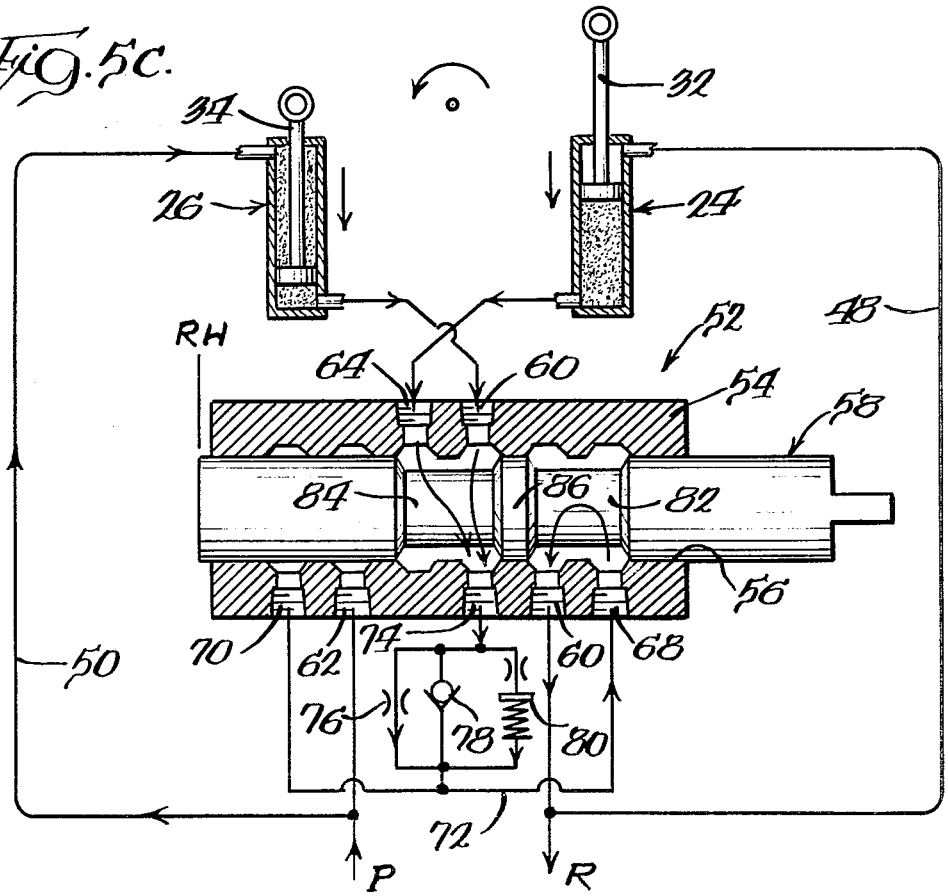

With reference now to FIGS. 5A–5C, the operation of the hydraulic system of the subject invention will be described as the swing tower 14 and boom 20 of the backhoe are swung counterclockwise from their extreme right-hand position (shown in phantom in FIG. 3C) to their extreme left-hand position (shown in FIG. 3A).

When motors 24 and 26 are as shown in FIG. 5A, the swing tower 14 of the backhoe is at one end of its arc of travel. Hydraulic motor 26 is illustrated in its overcenter configuration, while hydraulic motor 24 is shown in its fully contracted position. It should be noted that as the swing tower is rotated counterclockwise, the supply of pressurized hydraulic fluid from control valve 44 of the system is reversed, as indicated by the reversal of the symbols R and P (reservoir and pump) on FIGS. 5A–5C. Because the position of valve spool 58 within the valve body 54 of the sequencing valve 52 is a function of the position of the boom relative to the frame 10 of the backhoe, spool 58 is shown in its left hand position, as similarly shown in FIG. 4C.

The position of valve spool 58 of valve 52 illustrated in FIG. 5A results in direction of pressurized fluid to the cylinder ends of both motors 24 and 26 from valve 52, and fluid pressurization of the piston rod end of motor 26. Thus, motor 24 provides the primary motive force for pivoting the swing tower and boom, while motor 26 provides a supplementary force.

Pressurized hydraulic fluid is supplied to the system from P. Conduit 50 is pressurized with this fluid, and pressurized hydraulic fluid is directed to valve passage 62 defined by the valve body 54. Because of the relative position of the valve spool 58 within the valve body 54, fluid flow between valve passages 62 and 70 is provided across recessed portion 84 of the valve spool 58. Pressurized fluid flow from valve passage 70 is directed by conduit 72 to the check valve 78 so fluid flow substantially bypasses the flow restricting portions of the hydraulic cushioning circuit, and flow through the circuit to the motors is substantially unrestricted.

Pressurized hydraulic fluid flows through the check valve 78 to the valve passage 74, which is in fluid flow communication with valve passages 64 and 66. Passages 64 and 66 are in communication across recessed portion 82 of the valve spool 58. The high pressure fluid is directed from valve passages 64 and 66 to the cylinder ends of hydraulic motors 24 and 26. Conduit 48 connects the piston rod end of hydraulic motor 24 with the reservoir of the hydraulic system. Thus, hydraulic motor 24 provides the primary motive force for rotating the swing tower 14 away from the travel stop, while motor 26 provides supplementary motive force due to the supply of pressurized fluid to both of its ends. As piston rods 32 and 34 are driven outwardly of their respective hydraulic motors 24 and 26, the swing tower and boom of the backhoe are rotated in a counterclockwise direction away from the end of their arc of travel. Although conduit 50 is pressurized with hydraulic fluid, the flow within conduit 50 is away from the piston rod end of hydraulic motor 26.

With reference now to FIG. 5B, the hydraulic system is shown after the hydraulic motors 24 and 26 have rotated the swing tower 14 and boom 20 toward the central portion of their arc of travel (see FIG. 3B). Hydraulic motor 26 has moved out of its overcenter configuration and through its center position. As motor 26 moves through and out of its overcenter configuration, the operating mechanism for the sequencing valve 52 shifts the valve spool 58 within the valve body 54 to the center position. Thus, pressurized hydraulic fluid is supplied to opposite ends of the hydraulic motors 24 and 26 such that their piston rods 32 and 34 are moved outwardly and inwardly, respectively.

Pressurized hydraulic fluid is directed from the pump of the hydraulic system through conduit 50 to the piston rod end of hydraulic motor 26. Pressurized fluid is also directed to the valve passage 62 defined by valve body 54, which is in fluid flow communication with valve passage 64 and the cylinder end of hydraulic motor 24.

The piston rod end of hydraulic motor 24 is connected by conduit 48 with the reservoir of the hydraulic system. The cylinder end of hydraulic motor 26 is connected with the reservoir of the hydraulic system through valve passage 66 which is in flow communication with valve passage 60 across recessed portion 82 of the valve spool 58. It will be noted that in this operational phase the hydraulic cushioning circuit is in fluid flow isolation, thus assuring relatively unrestricted movement of the swing tower and boom through the central portion of the arc of travel.

With reference now to FIG. 5C, the hydraulic system is shown after hydraulic motor 24 has passed through its center position and has gone overcenter (see FIG. 3A, noting counterclockwise rotation). As hydraulic motor 24 moves through its center position and goes overcenter, the valve operating mechanism which operatively connects the valve spool 58 with the swing tower 14 shifts the valve spool 58 toward its right hand position within the valve body 54.

As the swing tower and boom are moved by the hydraulic motors 24 and 26 toward the end of their arc of travel, hydraulic motor 26 provides the primary motive force for rotation of the swing tower. High pressure hydraulic fluid is supplied from the pump of the hydraulic system through conduit 50 to the piston rod end of hydraulic motor 26. The piston rod end of hydraulic motor 24 is connected with the reservoir of the hydraulic system by conduit 48, although flow through conduit 48 will be into the piston rod end of hydraulic motor 24 since both piston rods 32 and 34 will move inwardly of hydraulic motors 24 and 26.

In order to provide hydraulic cushioning for the system as the boom is moved through the end portion of its arc of travel and approaches its travel stop, fluid flow from the cylinder end of each of the hydraulic motors 24 and 26 is directed to valve passage 74, which is in fluid flow communication with valve passages 60 and 64, which communicate across recessed portion 84 of the valve spool 58. Fluid flows through valve passage 74 to the cushioning circuit, and through orifice 76 resulting in the creation of cushioning back pressure in the circuit. When fluid back pressure reaches a predetermined value, relief valve 80 opens to permit flow to conduit 72. Even though relief valve 80 is open, the orifice in the relief valve results in a continuing increase in cushioning back pressure in the circuit. During those operating conditions when the volumetric flow of fluid is insufficient to open relief valve 80, orifice 76 permits fluid flow through the cushioning circuit. As noted, metering grooves provided on land 86 of valve spool 58 permit some flow of fluid to bypass the cushioning circuit by flowing over the land and through valve passage 60 (to the reservoir) until full hydraulic cushioning is desired.

Fluid entering conduit 72 from the cushioning circuit is directed to valve passage 68, which is in fluid flow communication with the valve passage 60 across recessed portion 82 of the valve spool 58. The flow of fluid is then directed to the reservoir of the hydraulic system. Thus, hydraulic cushioning is provided for the system as the hydraulic motor 26 moves the swing tower and boom toward the end of their arc of travel.

The advantages of the above-described system will be readily apparent to those familiar with the art. By providing a single hydraulic cushioning circuit which serves to cushion both of the hydraulic motors of the swing mechanism only during movement of the swing tower and boom of the backhoe through the end portions of their arc of travel toward the travel stops, a vastly improved and simplified swing mechanism hydraulic system is provided.

Among the distinct advantages of the present system over systems currently in use is the elimination of stingers and relief valves from the cylinders of each of the hydraulic motors. Clearly, this is advantageous in reducing both fabrication costs and maintenance expenses. Additionally, the removal of the usual orifices from each of the hydraulic motors improves the efficiency of the system since the orifices restrict fluid flow and generate back pressure at undesired times, and act to increase the temperature of hydraulic fluid in the system. Further, the removal of the usual orifices from the hydraulic motors increases the acceleration and average top speed of the swing tower and boom assembly, particularly when the assembly is stopped and then restarted with one of the hydraulic motors in an overcenter condition. Thus, swing times and energy loss are decreased, while productivity of the backhoe increased.

Further benefits of the present system relate to a decrease in peak cushioning back pressures. Since all cushioning is provided by restricting the fluid flow from only one hydraulic motor in a typical stinger/orifice cushioning arrangement, the back pressure created is relatively high. In contrast, the present system provides cushioning by restricting flow from the cylinder ends of both hydraulic motors, so peak back pressures are substantially reduced while the same amount of hydraulic cushioning may be provided. This is a significant improvement over previous arrangements, and greatly enhances the reliability of the entire swing mechanism.

The present hydraulic system further provides the operator of the backhoe with better stopping control as well as smoother stopping. Since a single cushioning circuit effects cushioning of both hydraulic motors at both ends of travel of the boom assembly, cushioning is consistent. In conventional arrangements where orifices in the motors restrict flow from one motor or the other to effect cushioning, minor variations in the size and finish of the orifices in the motors can result in inconsistent cushioning from one end of travel of the boom assembly to the other. Additionally, the cushioning effect of the present system may be readily altered for adaptability of the system to various attachments which may be supported by the boom of the backhoe by changing the size of orifice 76 by adjusting relief value 80 (if adjustable in nature), or by changing the size of the orifice of the relief valve.

The present invention further provides improved torque characteristics for the backhoe swing mechanism by the selective direction of hydraulic fluid to the hydraulic motors by sequencing valve 52. A significant benefit of the improved torque characteristics of the present swing mechanism relates to the type of hydraulic motor which may be used in system, and the degree of movement through which the backhoe boom assembly may be pivoted. In current arrangements, it has been typically necessary to employ trunnion-mounted hydraulic motors in order to achieve a range of swinging movement for the boom assembly through approximately 180 degrees. This is because end-mounted hydraulic motors, which are usually less costly to use, cannot be readily mounted to provide as wide a range of motion. When conventionally ported end-mounted motors are employed, the geometery of the system is usually such that the negative torque applied to the boom assembly when one of the motors is in its overcenter configuration cannot be sufficiently overcome by the non-overcenter motor to permit a range of motion in excess of approximately 160–170 degrees. Since the present swing mechanism obviates the problems heretofore associated with the application of this negative torque to the boom assembly, end-mounted hydraulic motors may be readily employed without detriment to the available range of pivoting movement of the boom assembly. This represents a distinct improvement upon previously known mechanisms.

DESCRIPTION OF ALTERNATE EMBODIMENT

Figure 6:
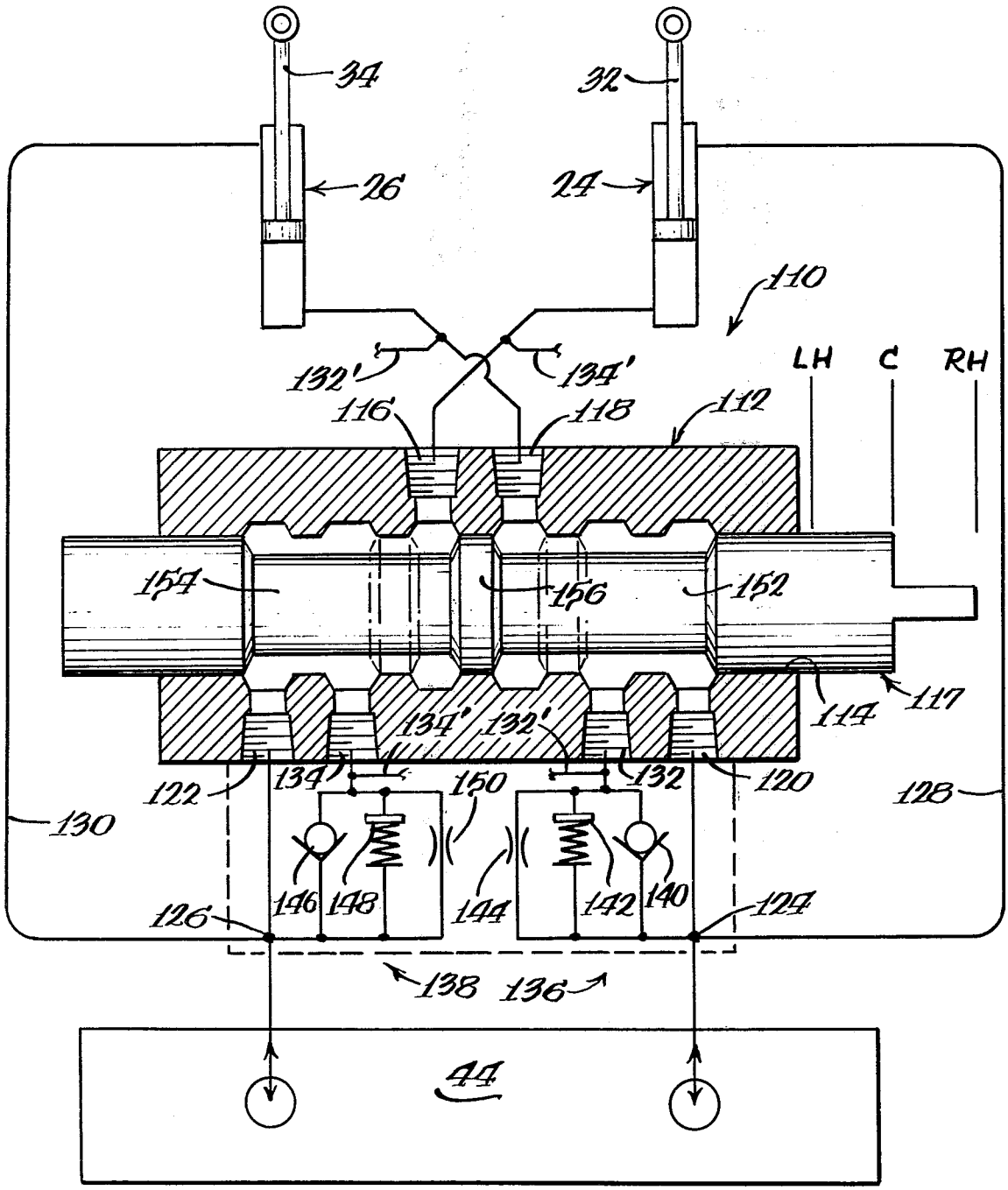
FIG. 6 illustrates an alternate embodiment of the sequencing valve and hydraulic control circuit of the present invention.

With reference now to FIG. 6, therein is shown an alternate embodiment of the hydraulic control and cushioning system of the present invention. This arrangement would be operatively associated with the swing mechanism of the backhoe in a manner as described above wherein the sequencing control and cushioning system would be hydraulically joined between the cylinder ends of hydraulic motors 24 and 26 and the control valve 44 through which the backhoe operator directs the swinging motion of the swing tower and boom of the backhoe.

As shown in FIG. 6, the system includes a sequencing valve 110 which includes a valve body 112 which defines an axial bore therein 114. A valve spool 117 is slidably disposed within the axial bore 114 and is shiftable with respect thereto between left hand (LH), right hand (RH) and center (C) positions by a valve operating mechanism which repositions the spool 117 within the valve body as a function of the position of the swing tower and boom of the backhoe. Suitable sealing arrangements are provided between the valve body 112 and the valve spool 117 (not shown) to prevent leakage of fluid from the interior of the valve body about the ends of the valve spool.

Valve body 112 defines a plurality of valve passages which are in fluid flow communication with the interior axial bore 114 of the body. First and second valve passages 116 and 118 are respectively connected in fluid communication with the cylinder ends of hydraulic motors 24 and 26. Third and fourth valve passages 120 and 122 are respectively in fluid communication with fluid junctions 124 and 126, through which hydraulic fluid flows to and from the control valve 44. Conduits 128 and 130 respectively connect the fluid junctions 124 and 126 in fluid communication with the piston rod ends of hydraulic motors 24 and 26.

The valve body 112 further defines fifth and sixth valve passages 134 and 132 which are respectively in fluid flow communication with a pair of hydraulic cushioning circuits 136 and 138. As indicated by the phantom line in FIG. 6, it is contemplated that the hydraulic cushioning circuits be incorporated in the body of valve 110, but it will be appreciated that various arrangements would function in the intended manner.

While passages 132 and 134 are shown communicating directly with interior bore 114 for clarity, it is contemplated that passages 132' and 134' (shown schematically) are preferably instead provided respectively providing fluid communication between circuits 136 and 138 and the cylinder ends of motors 24 and 26. In essence, fluid communication is respectively provided between the piston rod end of one motor and the cylinder end of the other motor across one of the cushioning circuits. Since the cylinder ends of the motors are in selective fluid communication during operation of valve 110, this arrangement provides fluid flow to and from the cylinder ends of both motors 24 and 26 through one cushioning circuit or the other during movement of the backhoe boom assembly through one end portion or the other of its arc of travel. It will be appreciated that various arrangements may be provided in order to effect the intended fluid communication in the system.

The hydraulic cushion circuit 136 includes, arranged in parallel flow relation, a one-way check valve 140, a flow restricting, pressure responsive relief valve 142 (including an orifice), and a flow restricting orifice 144. One end of each of the check valve 140, relief valve 142, and orifice 144 is in fluid communication with the valve passage 132, while the other end of each is connected with fluid junction 124 (and thus in communication with the piston rod end of motor 24 via conduit 128, and control valve 44). Similarly, hydraulic cushion circuit 138 includes a one-way check valve 146, a flow restricting, pressure responsive relief valve 148 (including an orifice), and a flow restricting orifice 150, one end of each being in flow communication with the valve port 134, and the other end of each being connected with fluid junction 126 for communication with the piston rod end of motor 28 and control valve 44.

The valve spool 117 defines a pair of recessed portions 152 and 154, which are divided by a circumferential land 156. Shifting of valve spool 117 between its different positions within the valve body 112 provides fluid flow communication across the recessed portions between at least two of the different valve passages defined by the valve body 112. Land 156 preferably includes metering grooves to provide a transitional period as the valve spool is shifted from one position to another.

The operation of the sequencing valve 110 is similar to the operation of the above-described sequencing valve 52. It is contemplated that a valve operating mechanism which operatively associates the valve spool 117 with the rotating swing tower of the backhoe causes the valve spool to be operatively repositioned within the valve body 112 generally whenever either of the hydraulic motors 24 or 26 passes through its center, or fully extended, position and moves through its overcenter condition. However, the timing of the shifting of valve spool 117 is a matter of design choice, depending upon the desired operational characteristics at the swing mechanism. The sequencing valve 110 and hydraulic cushion circuits 136 and 138 provide all of the distinct operational advantages of the above-described sequencing valve and hydraulic cushioning circuit of the preferred embodiment of the present invention. The inclusion of a pair of hydraulic cushion circuits provides additional versatility for adjustment of the hydraulic cushioning effect which may be desired in certain applications.

The function of the swing mechanism will now be described as the backhoe boom assembly is rotated clockwise through its arc of travel.

When the swing tower 14 and hydraulic motors 24 and 26 of the backhoe are in the position illustrated in FIG. 3A, the valve spool 117 of the sequencing valve 110 is in its left hand (LH) position. Hydraulic motor 24 is in its overcenter configuration, and if the swing tower and boom are being moved away from the end of the arc of travel, pressurization of both sides of hydraulic motor 24, and the cylinder end of hydraulic motor 26 is desired. This is accomplished by supplying pressurized hydraulic fluid to the fluid junction 124 from the control valve 44. The conduit 128 is pressurized, and pressurized hydraulic fluid flows substantially unrestricted through the check valve 140 of cushioning circuit 136 to the valve passage 132. Valve passages 132 is in fluid flow communication with valve passages 116 and 118 across recessed portion 152 when the valve spool 117 is in the left hand position. Thus, the piston rod end of motor 24 is pressurized and high pressure hydraulic fluid is directed to the cylinder ends of both motors 24 and 26 by sequencing valve, thereby acting to drive pistons 32 and 34 outwardly.

Hydraulic fluid from the piston rod end of hydraulic motor 26 returns to the reservoir of the hydraulic system through conduit 130 and fluid junction 126. The primary forces for rotation of the swing tower away from the travel stop is provided by hydraulic motor 26, while the pressurization of both sides of hydraulic motor 24 provides supplemental torque to the swing tower and boom.

As the swing tower 14 and hydraulic motors 24 and 26 move to the position illustrated in FIG. 3B, the valve operating mechanism shifts the position of the valve spool 117 within the valve body 112 to its center (C) position. This center position of valve spool 117 is illustrated in FIG. 6 in solid line. Control valve 44 continues to supply pressurized hydraulic fluid to fluid junction 124, from which pressurized fluid is directed to the piston rod end of hydraulic motor 24 through conduit 128. Hydraulic fluid is also directed from the fluid junction 124 to the valve passage 120, which is in fluid flow communication with valve passage 118 across recessed portion 152 of the valve spool 117. From valve passage 118 the pressurized hydraulic fluid is directed to the cylinder end of hydraulic motor 26.

The piston rod end of hydraulic motor 26 is connected by conduit 130 to fluid junction 126, which is in flow communication with the reservoir of the hydraulic system. The cylinder end of hydraulic motor 24 is also connected with the reservoir of the hydraulic system by valve passage 116 which is in fluid flow communication with valve passage 122 across recessed portion 154 of the valve spool 117. Hydraulic fluid returns to the reservoir from valve passage 122 through fluid junction 126. Thus, as the swing tower and boom are rotated through the central portion of their arc of travel, piston rods 32 and 34 respectively move inwardly and outwardly of hydraulic motors 24 and 26 as pressurized fluid is supplied to opposite ends of the motors.

As the hydraulic motors 24 and 26 continue to rotate clockwise the swing tower 14 through the position illustrated in FIG. 3C, the valve operating mechanism repositions the valve spool 117 within the valve body 112 toward its right hand (RH) position as the hydraulic motor 26 moves through its center position and goes overcenter. As sequencing valve 110 is moved toward its right hand position, hydraulic cushioning of the hydraulic motors 24 and 26 is initiated by hydraulic cushioning circuit 138. Specifically, control valve 44 continues to supply pressurized hydraulic fluid to the fluid junction 124, from which fluid flow continues through conduit 128 to the piston rod end of hydraulic motor 24. The shifting of the valve spool 117 to its right hand position places the valve passages 116 and 118 in fluid flow communication with each other, and thus the cylinder ends of both motors 24 and 26 communicate with valve passage 134 and the hydraulic cushioning circuit 138.

As the piston rods 32 and 34 each move inwardly of hydraulic motors 24 and 26 (hydraulic motor 26 being in its overcenter configuration), hydraulic fluid is directed from the cylinder ends of each of the hydraulic motors 24 and 26 to the hydraulic cushioning circuit 138. Fluid flows through orifice 150 which creates back pressure in circuit 138 to effect cushioning. When back pressure reaches a predetermined value, relief valve 148 opens so that fluid flows through relief valve 148 to fluid junction 126. When relief valve 148 is open its orifice acts to further increase fluid back pressure in the cushioning circuit as fluid flow increases so that full hydraulic cushioning is effected. Flow from the cushioning circuit 138 to fluid junction 126 is returned to the reservoir of the hydraulic system through control valve 44.

Thus, hydraulic cushioning of the hydraulic motors is provided as the swing tower and boom of the backhoe move through the end portion of their arc of travel and approach the travel stop. When volumetric flow from the cylinder ends of the hydraulic motors 24 and 26 is insufficient to cause relief valve 148 to open, orifice 150 permits fluid flow through cushioning circuit 138. The necessary hydraulic cushioning is effectively provided as the swing tower and boom of the backhoe approach the end of their arc of travel, while swinging movement of the swing tower and boom away from their travel stop and through the central portion of their arc of travel is possible without unnecessary and undesired creation of back pressure by orifices or relief valves which ordinarily would be part of the hydraulic motors.

The sequencing valve 110 and hydraulic cushion circuits 136 and 138 provide the following control functions when the swing tower and boom of the backhoe are moved from the position shown in phantom in FIG. 3C counterclockwise through their arc of travel to the position illustrated in FIG. 3A. When moving the swing tower and boom from the right-hand travel stop, hydraulic motor 26 is in its overcenter configuration and valve spool 117 in its right-hand position. When so positioned, control valve 44 supplies pressurized hydraulic fluid to the fluid junction 126. So that hydraulic motor 26 (in its overcenter configuration) can provide supplementary torque in assisting hydraulic motor 24 in initiating movement of the swing tower and the boom of the backhoe, the control system pressurizes both sides of the hydraulic cylinder 26 as well as the cylinder end of hydraulic motor 24.

The pressurized hydraulic fluid supplied by the control valve 44 acts to pressurize conduit 130 in flow communication with the piston rod end of hydraulic motor 26. Pressurized hydraulic fluid is directed from the fluid junction 126 through the check valve 146 of hydraulic cushioning circuit 138. Fluid flows from check valve 146 through valve passage 134 to valve passages 116 and 118, which are in fluid flow communication across recessed portion 154 of valve spool 117 when the valve spool is in its right hand position. Thus, the cylinder ends of each of the hydraulic motors 24 and 26 are supplied with substantially unrestricted pressurized hydraulic fluid flow, with the piston rod end of hydraulic motor 24 being connected with the reservoir of the hydraulic system by conduit 128 and fluid junction 124. Hydraulic motor 24 provides the primary motive force for rotating the swing tower and boom counterclockwise away from the end of their arc of travel, while the pressurization of both sides of hydraulic motor 26 results in additional torque being applied to the swing tower 14 as both piston rods 32 and 34 are driven outwardly of their respective hydraulic motors 24 and 26.

As the hydraulic motors 24 and 26 rotate the swing tower and boom toward the central portion of their arc of travel, the valve operating mechanism repositions the valve spool 117 within the valve body 112 (see FIGS. 3B and 3C, noting counterclockwise rotation of swing tower 14). As motor 26 moves out of its overcenter condition, the valve operating mechanism moves the valve spool 117 from its right hand position to its center position, illustrated in FIG. 6.

High pressure hydraulic fluid being supplied by control valve 44 to fluid junction 126 provides flow of high pressure fluid through conduit 130 to the piston rod end of hydraulic motor 26. High pressure fluid is also directed from the fluid junction 126 to the valve passage 122, which is in fluid flow communication with valve passage 116 across recessed portion 154 of valve spool 117. The pressurized fluid is directed from the valve passage 116 to the cylinder end of hydraulic motor 24.

The piston rod end of hydraulic motor 24 is connected with the reservoir of the hydraulic system through conduit 128 and fluid junction 124. The cylinder end of hydraulic motor 26 is connected with the reservoir of the hydraulic system through valve passage 118, which is in fluid flow communication with valve passage 120 across recessed portion 152 of the valve spool 117. Thus, respective expansion and contraction of hydraulic motors 24 and 26 by supply of pressurized fluid to opposite sides thereof provides rotation of the swing tower and boom of the backhoe through the central portion of their arc of travel without the creation of unnecessary and undesired back pressure by the hydraulic system.

As the hydraulic motors 24 and 26 continue to rotate the swing tower and boom counterclockwise toward the end of their arc of travel, hydraulic motor 24 passes through its center position and goes overcenter (see FIGS. 3B and 3A, noting counterclockwise rotation). As hydraulic motor 24 moves through its center position, the valve operating mechanism repositions the valve spool 117 within the valve body 112, shifting the spool 117 from its center position toward its left-hand (LH) position. When spool 117 is in its left-hand position, hydraulic cushioning circuit 136 is connected in fluid flow communication with the cylinder ends of the hydraulic motors 24 and 26 through valve passages 116 and 118, which are in communication across recessed portion 152. The control valve 44 continues to supply high pressure hydraulic fluid to the piston rod end of hydraulic motor 26 through fluid junction 126 and conduit 130.

As each of the piston rods 32 and 34 are moved inwardly of hydraulic motors 24 and 26 (hydraulic motor 24 being overcenter), the hydraulic fluid from both their cylinder ends is directed across to cushioning circuit 136. Fluid back pressure is initially created by restricted flow of fluid through orifice 144 to effect hydraulic cushioning. When back pressure increases to a predetermined value, relief valve 142 opens, with its orifice providing a further increase in cushioning back pressure with increased fluid flow thus cushioning the movement of the swing tower and the boom of the backhoe as they approach the travel stop. Fluid flow through relief valve 142 and orifice 144 is directed through fluid junction 124 and back to the reservoir of the hydraulic system. As described, in situations where the volumetric flow from the cylinder ends of hydraulic motors 24 and 26 is insufficient to result in the opening of relief valve 142, orifice 144 permits flow of fluid through the cushioning circuit.

The varied and significant advantages and features of the present hydraulic control system will be readily appreciated. Elimination of stingers, orifices, and relief valves from each of the hydraulic motors of the swing mechanism greatly enhance simplicity of the system resulting in significantly decreased fabrication and operating costs. At the same time, the control system of the subject invention provides improved control of the swinging movement of the backhoe boom, and increases productivity of the backhoe by providing the hydraulic control system and cushioning arrangement which permits increased acceleration and average speed of the swing movement of the boom with improved and smoother stopping of the assembly. The relief valves provided in the system may be of an adjustable type, and the restricting orifices changed to accommodate use of different types of implements on the backhoe boom. Naturally, the reduction in the number of parts of the present system in comparison to conventional control and cushioning arrangements significantly increases the reliability of the system, which is particularly important in view of the rugged and demanding use to which backhoes are typically subjected.

From the foregoing, it will be observed that numerous variations and modifications may be effected without departing from the true spirit and scope of the novel concept of the subject invention. It will be understood that no limitation with respect to the specific apparatus illustrated herein is intended or should be inferred. It is, of course, intended to cover by the appended claims all such modifications as fall within the scope of the claims.

What is claimed is as follows:

1. In an implement having a frame attached to a tractor having a hydraulic system, and a swing tower pivotally connected to said frame about a vertical pivot axis and supporting a boom, an arrangement for pivoting said swing tower and said boom through an arc about said vertical axis through an arc of travel, comprising:

(a) two hydraulic motors pivotally interconnected between the frame and the swing tower, each of said motors having a cylinder end and a piston rod end, the extension and contraction of said motors pivoting said swing tower about said vertical pivot axis on the frame, each of said motors being fully extended when its respective centerline intersects said vertical axis;

(b) a hydraulic circuit connected to each motor by conduit means leading from the tractor hydraulic system;

(c) directional flow control means operatively connected to said conduit means for selectively directing fluid under pressure from said hydraulic system to said two hydraulic motors;

(d) restricting means in said hydraulic circuit for restricting fluid flow from both of said motors during movement of said swing tower and said boom through end portions of their arc of travel prior to reaching the ends of the arc of travel; and (e) said hydraulic circuit including sequencing valve means hydraulically joined to said motors, said flow control means, and said restricting means, whereby when said flow control means direct fluid to pressurize the piston rod end of one of said motors in pivoting said swing tower through said arc, said sequencing valve means sequentially provides fluid communication between:

said one piston rod end and both the cylinder ends across said restricting means;

said one piston rod end and the cylinder end of the other motor, and between the cylinder end of the one motor and the piston rod end of the other motor; and both the cylinder ends and the piston rod end of the other motor across said restricting means.

2. The apparatus as set forth in claim 1, wherein said restricting means comprises check valve means for providing substantially unrestricted flow to said motors.

3. The apparatus as set forth in claim 2, wherein said sequencing valve means includes:

(a) a valve housing having a bore; and (b) a valve spool disposed within a bore of said valve housing for axial movement therein, said spool and said valve housing cooperating to control the flow of fluid to and from the cylinder ends of said two hydraulic motors.

4. The apparatus as set forth in claim 3, wherein said valve housing has a plurality valve passages communicating with said bore: two of which are in flow communication with the piston rod ends of said two hydraulic motors; two of which are in flow communication with the cylinder ends of said two hydraulic motors; and two of which are in flow communication with each other; and said restricting means being in flow communication with said two passages in flow communication with each other, and in flow communication with one of said passages in communication with the cylinder end of one of said motors.

5. The apparatus as set forth in claim 4, wherein said restricting means includes fluid flow restricting means and a one way check valve disposed in parallel flow relation between said one valve passage and said two valve passages communicating with each other, said check valve operating to permit substantially unrestricted fluid flow from either of said two passages in communication with each other to said one passage.

6. The apparatus as set forth in claim 3, wherein said valve housing has a plurality of valve passages communicating with said bore: two of which are in flow communication with the piston rod ends of said two hydraulic motors; two of which are in flow communication with the cylinder ends of said hydraulic motors; and two of which are in flow communication with said restricting means.

7. The apparatus as set forth in claim 6, wherein said restricting means comprises a pair of flow restricting circuits respectively in flow communication with said two of said valve passages communicating with said restricting means and said two of said valve passages communicating with said piston rod ends of said hydraulic motors, each of said circuits comprising fluid flow restricting means and a one way check valve disposed in parallel flow relation, said check valve operating to permit substantially unrestricted fluid to said motors through said restricting means.

8. The apparatus as set forth in claim 3, wherein said valve housing has a plurality of valve passages communicating with said bore: two of which are in flow communication with the piston rod ends of said motors; and two of which are in flow communication with the cylinder ends of the motors;

said restricting means comprising a pair of flow restricting circuits, restricting each circuit respectively disposed in fluid communication between the piston rod end of one motor and the cylinder end of the other motor.

9. The apparatus as set forth in claim 1, wherein said sequencing valve means redirects hydraulic fluid flow to the cylinder ends of said hydraulic motors: first generally when the centerline of the other of said two hydraulic motors intersects the vertical axis of the swing tower, and then generally when the centerline of said one hydraulic motor intersects the vertical axis.

10. In an implement having a fixed member attached to a frame and a pivoting member that is pivotally connected to said fixed member for rotational movement about a vertical axis, a mechanism for rotating said pivoting member through an arc about said vertical axis, comprising:

(a) at least two hydraulic motors pivotally interconnected between said fixed member and said pivoting member to rotate said pivoting member relative to said fixed member, by extension and contraction of the motors each of said motors having a piston rod end and a cylinder end and a fully-extending center position defined as that position where the centerline of the axis of the hydraulic motor intersects said vertical axis;

(b) fluid circuit means connected to said two hydraulic motors for selectively directing hydraulic fluid under pressure to actuate said hydraulic motors to rotate said pivoting member about said vertical axis, and (c) restricting means in said circuit means for restricting fluid flow from both said motors when said pivoting member is rotated through an end portion of said arc toward an end of said arc.

11. The apparatus as set forth in claim 10, wherein said restricting means includes one way valve means for permitting substantially unrestricted fluid flow to said motors through said restricting means, and flow restricting means in parallel flow relation with said one way valve means.

12. The apparatus as set forth in claim 10, wherein said circuit means includes sequencing valve means whereby said circuit means sequentially ports fluid under pressure: first to both ends of one motor and to one end of the other motor; then both to said one end and to the other end of said one motor; and then only to said other end of said one motor, in rotating said pivoting member through said arc.

13. The apparatus as set forth in claim 12, wherein said sequencing valve means includes a spool valve having first, second, and third positions respectively corresponding to the sequential direction of fluid under pressure, and first, second, third and fourth flow control passages, said first and third passages being in fluid communication with opposite ends of one hydraulic motor, and said second and fourth passages being in fluid communication with opposite ends of the other hydraulic motor.

14. The apparatus as set forth in claim 13, wherein:

(a) the first passage, the second passage and the third passage are in fluid communication with each other when said spool is in said first position;

(b) the first passage is in fluid communication with the fourth passage, and the second passage is in fluid communication with the third passage when said spool is in said second position; and (c) the first passage, the second passage, and the fourth passage are in fluid communication with each other when said spool is in said third position, whereby in each position of said spool at least two flow passages are joined together.

15. The apparatus as set forth in claim 14, wherein said spool valve further includes fifth and sixth flow control passages in fluid communication with each other and said restricting means, and means connecting said restricting means in flow communication with one of said first and second passages.

16. The apparatus as set forth in claim 15, wherein said restricting means includes fluid flow restricting means and a one way check valve disposed in parallel flow relation between said connecting means and said fifth and sixth passages, said check valve operating to permit substantially unrestricted fluid flow through said restricting means to said hydraulic motors.

17. The apparatus as set forth in claim 16, wherein said fluid flow restricting means comprises a restricting valve responsive to fluid pressure from said connecting means, and low pressure restricting means for restricting relatively small fluid flow arranged in parallel flow relation with said restricting valve.

18. The apparatus as set forth in claim 17, wherein said low pressure restricting means comprises an orifice.

19. The apparatus as set forth in claim 14, wherein said restricting means comprises a pair of flow restricting circuits respectively in fluid communication between said first and fourth passages, and said second and third passges, each of said circuits including check valve means for permitting substantially unrestricted flow through the circuit to motors.

* * * * *